US007980393B2

(12) United States Patent
Fennekotter et al.

(10) Patent No.: US 7,980,393 B2
(45) Date of Patent: Jul. 19, 2011

(54) VIBRATING SCREENING MACHINE

(75) Inventors: Klaus Fennekotter, Munster (DE); Rudiger Heinrich, Fenwick (CA); Dieter Takev, Saint Catharines (CA)

(73) Assignee: Haver & Boecker Ohg, Oelde (DE)

( * ) Notice: Subject to any disclaimer, the term of this patent is extended or adjusted under 35 U.S.C. 154(b) by 489 days.

(21) Appl. No.: 12/014,433

(22) Filed: Jan. 15, 2008

(65) Prior Publication Data

US 2008/0169223 A1 Jul. 17, 2008

(30) Foreign Application Priority Data

Jan. 17, 2007 (DE) ..... 10 2007 003 359

(51) Int. Cl.
*B07B 1/46* (2006.01)

(52) U.S. Cl. ..... 209/409; 209/317; 209/408

(58) Field of Classification Search ..... 209/315, 209/317, 355, 405, 408, 409
See application file for complete search history.

(56) References Cited

U.S. PATENT DOCUMENTS

| | | | | | |
|---|---|---|---|---|---|
| 1,693,940 | A * | 12/1928 | Robins | | 209/326 |
| 2,345,947 | A * | 4/1944 | Parks | | 209/408 |
| 4,504,386 | A * | 3/1985 | Dyren et al. | | 209/254 |
| 4,732,670 | A | 3/1988 | Nelson | | |
| 4,840,728 | A | 6/1989 | Connolly | | |
| 5,341,939 | A * | 8/1994 | Aitchison et al. | | 209/319 |
| 5,397,002 | A * | 3/1995 | Lambert | | 209/347 |
| D418,656 | S * | 1/2000 | Andersson | | D34/29 |
| 6,575,304 | B2 * | 6/2003 | Cudahy | | 209/365.3 |
| 6,666,336 | B2 * | 12/2003 | Kreft | | 209/365.3 |
| 7,114,620 | B2 * | 10/2006 | Anibas | | 209/319 |
| 2008/0011652 | A1 * | 1/2008 | Takev et al. | | 209/405 |

FOREIGN PATENT DOCUMENTS

| | | | |
|---|---|---|---|
| EP | 1 719 560 | A2 | 11/2006 |
| GB | 926 652 | A | 5/1963 |
| GB | 2 182 866 | A | 5/1987 |

* cited by examiner

*Primary Examiner* — Joseph C Rodriguez

(74) *Attorney, Agent, or Firm* — Pearne & Gordon LLP

(57) ABSTRACT

A vibrating screening machine for grading bulk materials and the like, with a housing and two sidewalls on which at least one screen deck is mounted on which a screen lining is retained, and a drive means to cause the screen deck to vibrate. Via a material feed, bulk material to be screened is fed and via at least one fine-grain discharge, fine-grain bulk material, and via at least one coarse-grain discharge, coarse-grain bulk material is discharged. The mounting points provided on the sidewalls for mounting at least one screen deck are aligned with a defined grid.

13 Claims, 4 Drawing Sheets

VIBRATING SCREENING MACHINE

Figure 1:
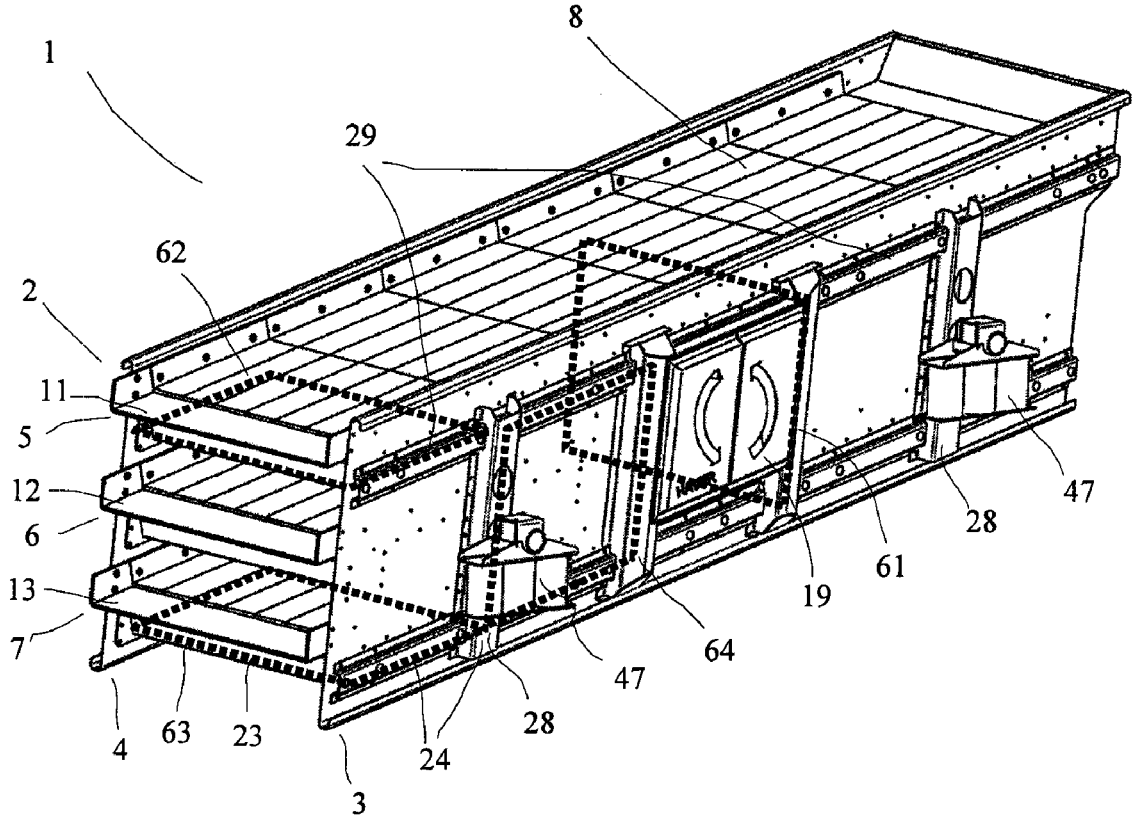

The present invention relates to a vibrating screening machine which is in particular suitable for grading bulk materials, in particular solid materials such as stones and the like, and which comprises a housing having two sidewalls on which at least one screen deck is mounted.

In the prior art these oscillating or vibrating screening machines have become known which are suitable e.g. for grading, preseparating, defillerizing, draining and/or e.g. for screening out foreign bodies. What occurs in grading is generally a separation of the screen feed stream in two or more equivalent products which are sorted according to grain size. The goal of preseparating is to separate out by means of a screening machine any material which is to be removed from the further processing. A typical example therefor is relieving the crusher before the primary crusher in a quarry. Any rocks whose size is already beneath specified dimensions should be made to bypass the primary crusher so as to relieve the crusher. Defillerizing is understood to mean the grading process in which foreign microparticles are separated or emaciated out of a product. Screening machines for screening out foreign bodies are employed for screening out foreign bodies which may occasionally occur in the screen feed.

All of these vibrating screening machines are designed and built according to their intended application and to requirements.

Vibrating screening machines for preseparating of different capacities operate as a rule on the same operating principle wherein only the dimensions differ. The drawback is that each vibrating screening machine is virtually an entirely new design although all of these machines employ the same vibrating principles and are intended for the same application.

In view of the known prior art it is therefore the object of the present invention to provide a vibrating screening machine which due to its structure and design allows better scalability to thus facilitate the manufacture of differently sized screening machines. One aspect of the object of preferred embodiments is to provide a vibrating screening machine more rigid in structure.

This object is solved by a device having the features of claim 1. Preferred specific embodiments and configurations of the invention are the objects of the subclaims.

The screening machine according to the invention is configured as a vibrating screening machine and serves to screen and in particular to grade bulk materials such as in particular solid materials and the like. The vibrating screening machine according to the invention comprises a housing and at least two sidewalls on which at least one screen deck is disposed on which in turn a screen lining is retained. At least one drive means is provided to cause the screen deck to vibrate and to assist the screening process. The vibrating screening machine according to the invention is provided with at least one material feed for bulk material to be screened and at least one fine-grain discharge for screened, fine-grain material, and at least one coarse-grain discharge for coarse-grain bulk material is provided. The mounting points provided on the sidewalls for mounting at least one screen deck are aligned with a defined grid.

The invention has many advantages. One considerable advantage is the arrangement of the mounting points in a defined grid so as to achieve easy scalability of the machine. Where a larger screen deck is intended, more mounting points are defined on the sidewall according to the predefined grid for the screen deck to be connected with the sidewall. The sidewall may be e.g. extended as necessary.

The invention allows a modular structure for such vibrating screening machines since it is possible to assemble vibrating screening machines of different sizes employing the same, standard components. The defined grid allows for each add-on part to be mounted on all systems, irrespective of the size of the system.

In the vibrating screening machine according to the invention the drive causes in particular not only the screen deck or the screen lining but the entire housing to vibrate and thus all of the vibrating decks provided.

The fine-grain material may be screened out once or multiple times while the coarse-grain material may be entirely unscreened or screened less thoroughly.

In a preferred embodiment of the invention the inventive vibrating screening machine comprises two or more screen decks whose mounting points on the sidewalls are aligned with the predefined grid. This more specific embodiment will achieve a particularly modular configuration.

An advantageous specific embodiment provides for the grid to comprise grid points aligned with an x-y system of coordinates. The path of the axes of the x-coordinate and the path of the y-coordinate preferably include a system angle which may differ from 90 degrees. In linear vibrating machines the system angle is in particular 90°. Although in particular other types of vibrating machines may provide for an angle larger than 90 degrees, said angle is preferably smaller than 90 degrees and lies in particular in the range between 45 and approximately 90 degrees, preferably in the range between approximately 60 and 80 degrees.

When assembled as intended, the screen deck is preferably disposed at a screen angle inclined relative to the horizontal to ensure that the materials to be screened out are transferred during screening. The angle of screen inclination is preferably between approximately 0 and 45 degrees and in particular between approximately 5 and 30 degrees. The angle of screen inclination is related to the bulk material to be screened and its characteristics, and other factors such as system performance etc.

When assembled as intended the y-coordinate is preferably substantially perpendicular to a horizontal axis such that the angle between the x-coordinate and the horizontal equals the angle of screen inclination.

In preferred embodiments the grid distance of the grid in the x-coordinate direction may be different from the grid distance in the y-coordinate direction. The grid distance ratio in the x-direction and in the y-direction may differ from one another by an integral or half-integral factor, although they may be quite independent of one another.

Although the distance between the individual grid points is generally arbitrary, reasonable ease of operation ought to be ensured.

Preferred grid distances in the x-direction or in the y-direction are therefore between approximately 25.4 mm and 508 mm. In the y-direction a grid distance of approximately 50 mm to 150 mm is preferred, being for example 100 mm. In the x-direction the grid distance may be larger, being preferably approximately 50 mm to 320 mm and it may be for example 150 mm or 300 mm.

In all of the configurations the cross-members of the screen deck are preferably flange-mounted to the sidewalls with the mounting points on the sidewall aligned with the grid. For mounting the flanges are screwed into holes in the sidewall which are e.g. drilled.

Screening machines are subjected to high stresses such that even sidewalls made of thick metal panels may fracture. Therefore it has been known in the prior art to screw or weld reinforcing panels onto the side walls in the area of the drive or in the areas of the mounting points of the particular screen decks. Such reinforcing panels of solid material considerably increase the weight of this screening machine while, the locally doubled weight notwithstanding, contributing little to enhancing the rigidity of the sidewalls.

In view of said prior art it is one object to provide a screening machine which allows a clearly increased rigidity while requiring relatively small quantities of material.

Said object is solved by a vibrating screening machine comprising a housing and at least two sidewalls on which at least one screen deck is mounted on which a screen lining is retained. Furthermore the vibrating screening machine comprises drive means to cause the screen deck to vibrate. To reinforce the sidewalls of such a vibrating screening machine, said sidewall has at least one reinforcing unit disposed on it connected with the sidewall, in particular forming a closed hollow part.

The applicant reserves the right to seek separate protection for such a vibrating screening machine.

In all of the above described configurations and specific embodiments of vibrating screening machines it is preferred to employ such a reinforcing unit. Preferably the reinforcing unit forms a hollow profile with the sidewall, e.g. in the shape of a hollow box which, although in general it may have any desired shape, it is in particular configured as a triangle, quadrangle or pentagon, and particularly it is preferably approximately a quadrangle.

In preferred embodiments the reinforcing unit is comprised of a curved metal sheet which forms three sides of the hollow profile with the surfaces leading toward the sidewall outwardly chamfered at the sidewalls, thus forming mounting edges abutting the sidewall by way of which the reinforcing panel is mounted on and in particular bolted to the sidewall.

Advantageously at least some of the mounting points for mounting the reinforcing unit also serve for mounting the cross-members.

It is preferred to use as the mounting means for mounting the reinforcing unit to the sidewall, rivets or bolts with the mounting points in particular being aligned with the grid.

Preferably, the reinforcing units provided on the sidewall are vertical which with the vibrating screening machine assembled as intended, are aligned substantially parallel to the y-coordinate and which may be substantially perpendicular to the horizontal.

Advantageously, longitudinal reinforcing units are provided which are in particular aligned substantially parallel to the x-coordinate and preferably disposed on the sidewall.

Both the vertical reinforcing units and the longitudinal reinforcing units preferably take the shape of a hollow box preferably at a uniform cross-section such that these reinforcing panels for the reinforcing unit are again modular in structure, thus allowing them to be cut to length as required.

The reinforcing units serve as integral vibration reinforcing which may considerably extend the service life of the inventive screening machine.

In particularly advantageous specific embodiments of the vibrating screening machine at least two reinforcing units and at least two cross-members form a frame which contributes to reinforcing the housing. Preferably pairs of reinforcing units with multiple cross-members form one frame each. These frames considerably contribute to a vibratory reinforcement of the vibrating screening machine which is why they may be called reinforcing frames.

Preferably at least one frame or at least one cross-reinforcing frame is provided that is formed by two vertical reinforcing units and some of the cross-members.

In another preferred embodiment at least one frame or at least one horizontal reinforcing frame is provided that is formed by at least two longitudinal reinforcing units and some of the cross-members.

It is particularly preferred that at least one frame or at least one side frame is provided which or each of which is formed by at least two vertical reinforcing units and by at least two longitudinal reinforcing units. In particular a few vertical reinforcing units and a few longitudinal reinforcing units may form one side frame. The sidewall may be incorporated in the side frame.

All of the frames or reinforcing frames described above, while requiring comparatively little material, advantageously contribute to a vibratory reinforcement of the machine.

By way or one or more horizontal reinforcement frames, cross-reinforcement frames, and side frames, a quite considerable, three-dimensional vibratory reinforcement is achieved with minimum material requirement, such that the machine service life is extended while downtime is reduced.

While the inventive vibrating screening machine is preferably configured as a circle-throw screening machine, it may be configured as an eccentric vibrating screening or a linear vibrating screening machine.

Possible applications are grading of gravel and split gravel, and grading of pebbles and sand, or grading of fertilizers, construction waste or limestone, or other materials.

By way of the defined layout or grid, the machine may be given a systematic structure with different modules wherein a defined grid is conceivable both for the metric and the Anglo-Saxon system of measures such that one grid may serve for structures in both of the systems of measures.

In the x-direction the grid distance may be matched to commonly used screen lining sizes.

The grid comprises grid points in the horizontal and vertical directions at specified distances in the x-direction and in the y-direction, including a specified offset to allow for the screen inclination. By way of the grid dimensions, defined screen deck distances are achieved for the specified storage groups. To allow for different measuring systems, elongated holes may be provided permitting e.g. distances of 100 mm and distances of four inch (101.6 mm).

By way of the chamfered metal profiles provided in the horizontal and in the vertical and screwed onto the sidewalls, thus forming the reinforcing units, the open metal profiles turn into closed reinforcing units, thus resulting in a particularly robust frame structure of the inventive screening machine. High rigidity is achieved while the weight is kept down.

By way of building reinforcing frames from the reinforcing units and the cross-members, the resulting structure will be particularly stable against vibration.

There is provided easy adaptation of further modules such as bearing, spring supports, cross-members or transverse members, by means of the grid or the hole matrix. There is furthermore optimal accessibility of the tightening bolts.

Figure 2:
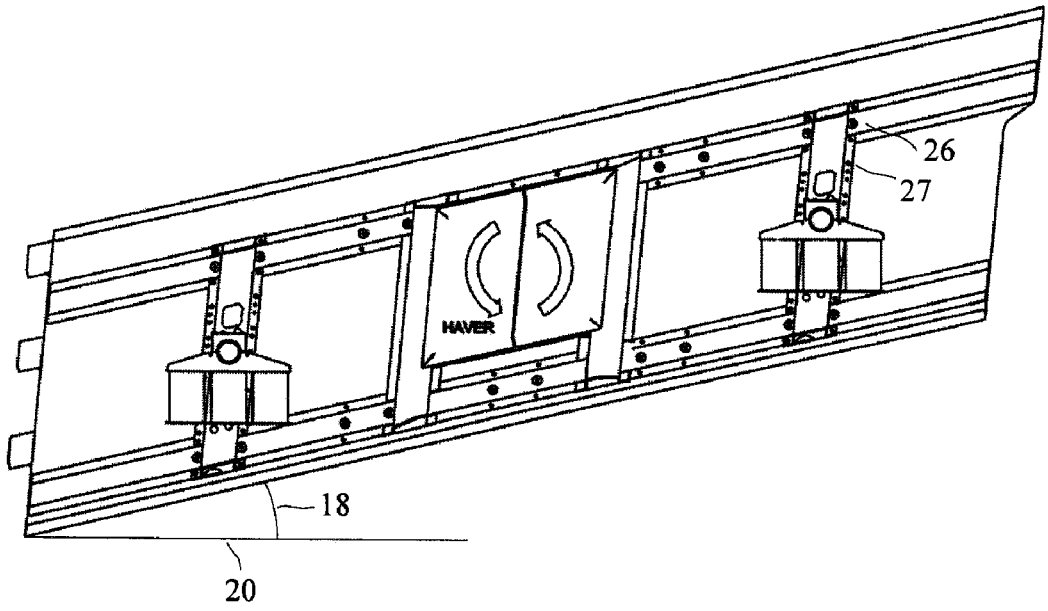
Figure 3:
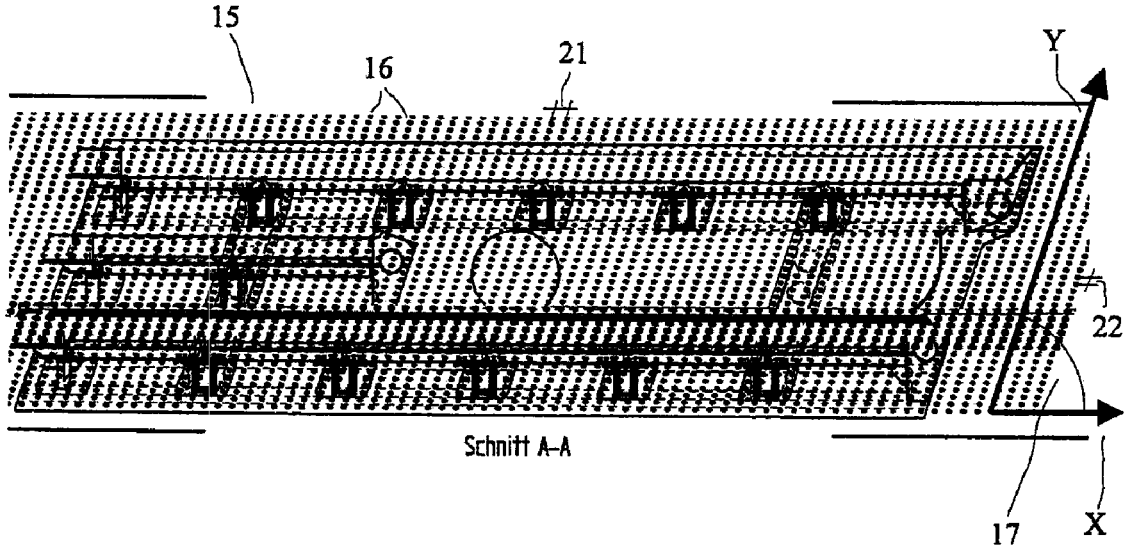
Figure 4:
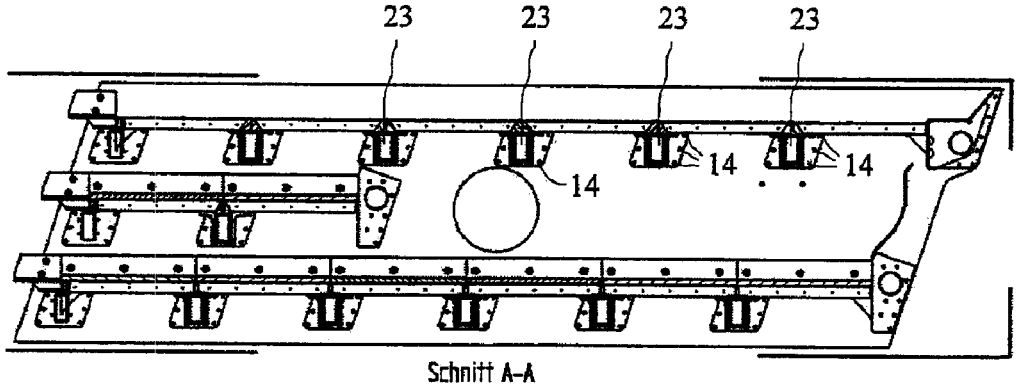
Figure 5:
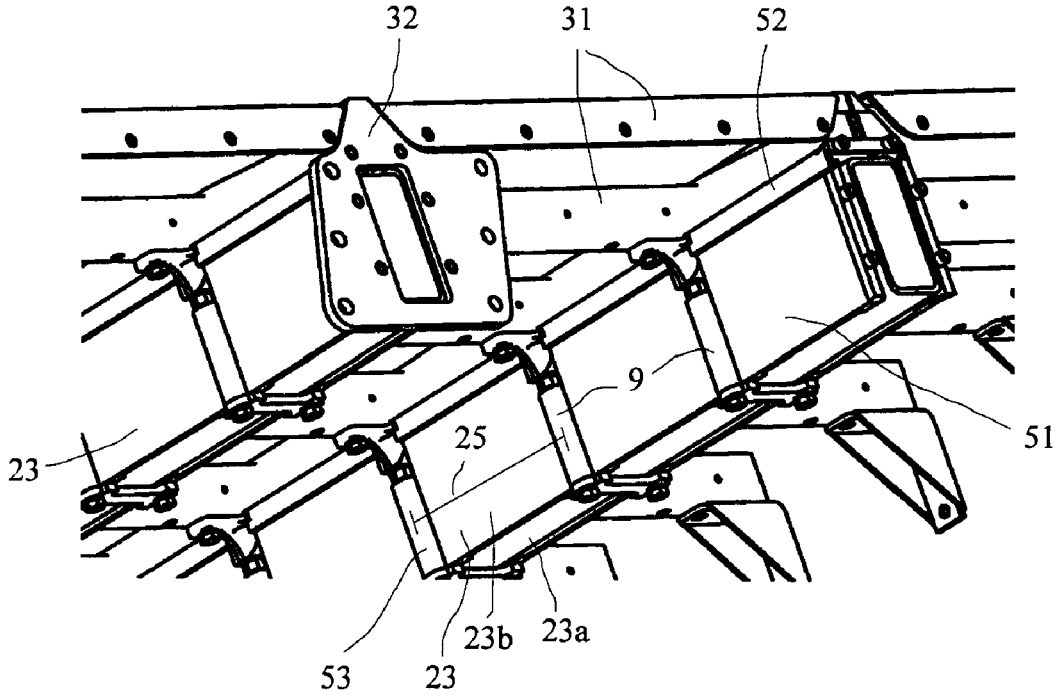
Figure 6:
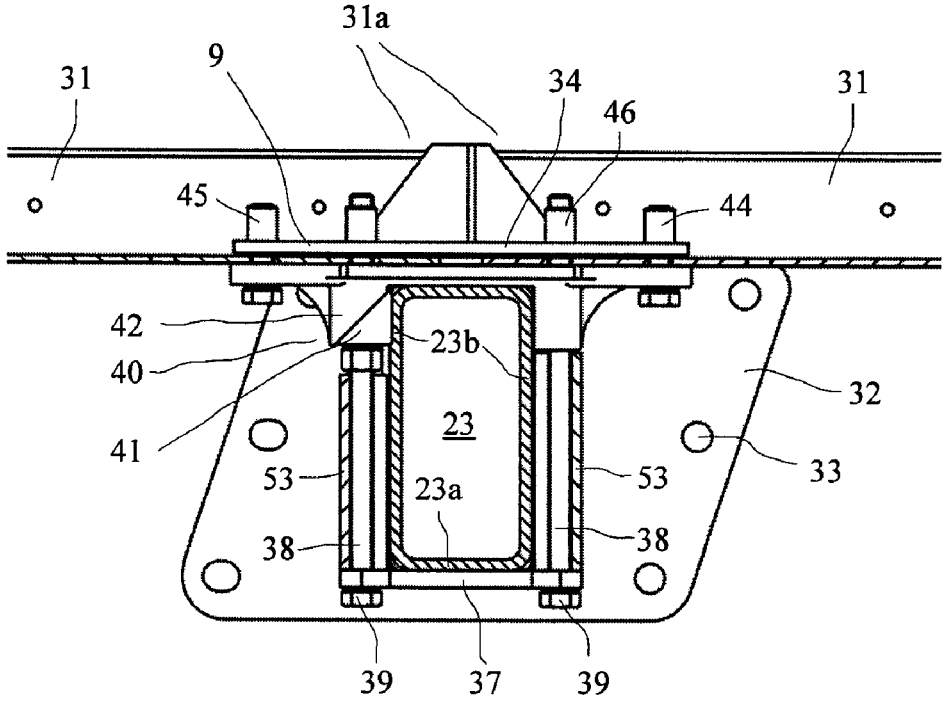
Figure 7:
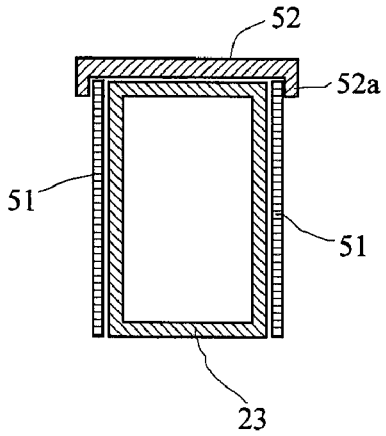
Figure 8:
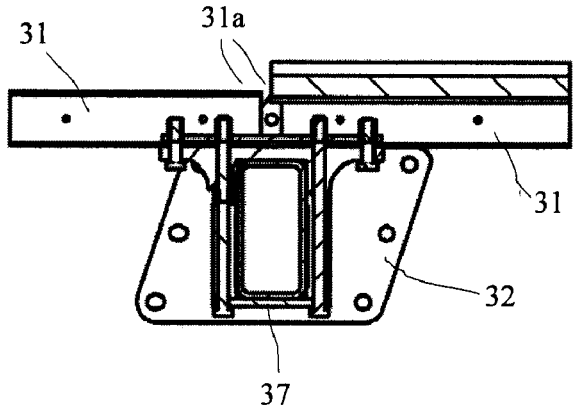
Figure 9:
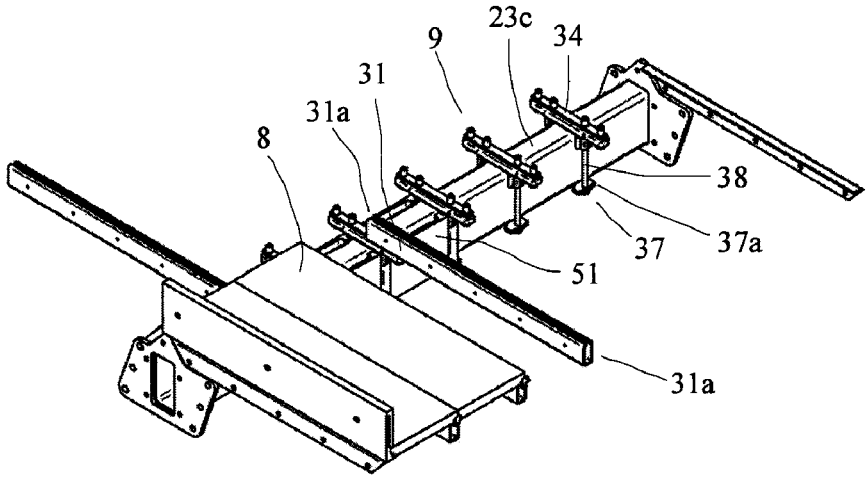
Figure 10:
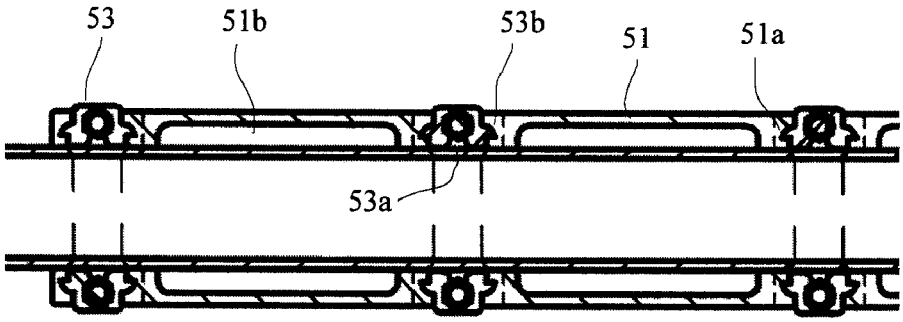

Further advantages and applications can be taken from the exemplary embodiment described below with reference to the enclosed Figures:

These show in:

FIG. 1 a schematic, perspective view of an inventive vibrating screening machine;

FIG. 2 a schematic view of a sidewall of the vibrating screening machine according to FIG. 1;

FIG. 3 a schematic side view of the sidewall with the grid inserted;

FIG. 4 a partially cutaway side view of the vibrating screening machine according to FIG. 1;

FIG. 5 a perspective bottom view of a screening deck with the sidewall removed;

FIG. 6 a side view of a mounting tie for the longitudinal members for a vibrating screening machine according to FIG. 1;

FIG. 7 a simplistic, vertical cross-section of a cross-member;

FIG. 8 another schematic cross-section of a cross-member showing a reinforcement unit;

FIG. 9 a schematic, perspective top view of a machine section with a cross-member; and FIG. 10 a schematic, horizontal cross-section of a cross-member.

With reference to the FIGS. 1 to 10, an embodiment of the present invention will now be described. FIG. 1 illustrates a total view of a screening machine 1 according to the invention configured as a vibrating screening machine.

Although the screening machine 1 in the present exemplary embodiment is in particular employed for grading bulk material such as gravel, split gravel, pebbles, sand, construction waste or limestone, it may be intended or serve for screening or grading other bulk materials.

The screening machine 1 comprises a housing 2 having sidewalls 3 and 4, with three screen decks 5, 6 and 7 disposed in between in the present example. The screen lining 8 of a screen deck may be configured as a tensioned wire mesh or as a perforated plate having holes that e.g. widen conically downwardly or in particular as a rubber or plastic lining in which holes are provided according to the appropriate grading specifications.

At what is the rear end of the screening machine 1 in the perspective illustration of FIG. 1, a material feed 10 is provided for feeding the bulk material to be graded to the screening machine. The graded bulk material, in relation to the fineness of grains, reaches the screen deck 6 or 7 or falls all the way down or remains on the screen deck 5 until it is carried off via the respective fine grain discharge 12 or 13 or the coarse grain discharge 11.

The present screening machine 1 is configured as a circular flexible-drive screening machine, comprising a drive 19 and four elastic support systems 47 to bear the screening machine 1 relative to the floor.

The sidewalls 3 and 4 are provided with horizontal and vertical reinforcing units 29 and 28 respectively which are configured as chamfered metal profiles.

The reinforcing units 28, 29, which are approximately rectangular in cross-section, are formed by the curved metal sheets on three sides and on one side by the sidewalls 3 and 4 respectively of the screening machine 1, thus considerably increasing the rigidity of the sidewalls such that the sidewalls do not require extensive doubling in loaded areas such that while the total weight of the screening machine and the amount of material required is reduced, the reinforcing effect is still enhanced.

The reinforcing units 28, 29 combined with the cross-members and the sidewalls form reinforcing frames wherein just a few reinforcing frames 61 to 64 are indicated by bold dotted lines in FIG. 1 by way of example.

The reinforcing frame 61 is formed by two vertical reinforcing units 28 and by the three horizontal cross-members 23 which in this longitudinal position hold the three screen decks 5, 6 and 7. The vertical reinforcing frame 61 and the other vertical reinforcing frames of the other vertical reinforcing units 28 result in an outstanding vibratory rigidity of the structure of the screening machine 1.

Longitudinal reinforcing frames 62 and 63 are formed by the horizontal or longitudinal reinforcing units 29 and the cross-members 23 associated with the screen deck 5 or 7 respectively. Further longitudinal reinforcing frames are formed by the further longitudinal reinforcing units 29 and the associated cross-members 23 such that in this plane high rigidity is again achieved.

In the third dimension, side reinforcing frames are formed of which the side reinforcing frame 64 is indicated by way of example as a bold dotted line.

The reinforcing frames 61 through 64 provided in all of the three dimensions result in a considerably increased vibratory rigidity of the screening machine 1 while providing only a moderate weight increase.

Another contributive factor is that individual screwed connections attach both the cross-member and a reinforcing unit to the sidewall to thus achieve an optimal connection.

When assembled as intended, the screen of the screening machine is inclined at an angle 18 which in the present embodiment is between approximately 10 and 30 degrees.

All of the mounting points 14 on the sidewall 3 and the sidewall 4 are aligned with a grid 15 which is provided with grid points 16.

The grid points are aligned with an x-y-coordinate system with the x-coordinate x presently aligned parallel to the bottom and top edges of the sidewalls 3 and 4 respectively. While the grid distance 21 between two grid points in the x-direction may equal the grid distance 22 in the y-direction, it may be independent of the grid distance 22 in the x-direction.

The y-coordinate is positioned relative to the x-coordinate at a system angle 17 which in the present exemplary embodiment is between approximately 60 and 80 degrees. Thus the x-y-coordinate system is not rectangular but has angles offset from 90 degrees by approximately 10 to 30 degrees.

In the present embodiment all of the mounting points 14 are selected with reference to the grid points 16, wherein reference is made to the fact that said grid points 16 may be virtual points such that not every grid point 16 illustrated in FIG. 3 needs to be visible on the sidewalls 3 and 4 of the screening machine.

In the screening machine 1 all of the mounting points 14 for mounting the cross-members 23 to the sidewalls 3, 4 are so aligned with the grid that the axial distance of specific mounting points on a cross-member 23 equals a multiple of the grid distance.

The distance in the x- or y-direction of a mounting point 14 of a cross-member 23 from a mounting point 14 of another cross-member 23 likewise equals a multiple of the grid distance so as to result in a modular and systematic structure of the machine which permits simple adaptation of other modules because a large variety of modules may be added on independently of the machine size.

FIG. 5 shows a perspective bottom view of two cross-members 23 with the sidewall 3 cut away. The cross-members 23 are attached to the sidewall 3 by means of flanges 32. The cross-members 23 are provided with mounting ties 9 at suitable lateral distances 25 to securely but removably connect the longitudinal members 31 with the cross-members 23.

The screwed connections of the longitudinal members 31 with the cross-members 23 prevent weld stresses so as to increase reliability and durability while employing a uniform wall thickness in the cross-members 23.

The way of attaching a mounting tie 9 to a cross-member 23 is shown in FIG. 6 in an enlarged section view. The counterplate 37 is pressed against the bottom face 23*a* of the cross-member 23 by way of the clamping force of the bolts 38. The bolt heads 39 of the bolts 38 abut the bottom face of the counterplate 37 while the threaded portions extend upwardly where they pass through bores in the retaining panel 34 and mounted on the top surface by means of nuts 46. Protectors may be provided to shield the threaded ends and the nuts 46 against damage from any graded material falling down.

The bolts 38 may be provided with mounting profiles 53 which in turn can receive wear protection elements.

Between the connecting means configured as a mounting bolt 38 and the lower edge of the retaining panel 34 a clamp 40 is provided comprising clamping parts 41 and 42 designed wedge-like with the inclined faces gliding upon one another. In the present embodiment the clamping part 42 is formed integrally with the retaining panel 34.

The mounting bolt 38 extends through an axial hole in the clamp 40 such that as the bolt 38 is tightened, the clamping part 41 moves axially in the direction of the retaining panel 34 such that the mounting part 41 is pressed against a side face 23*b* of the cross-member 23. In this way the clamping pressure achieved will be twofold wherein for one, the counterpanel 37 is pressed against the bottom face 23*a* of the cross-member 23 and for another, the clamping part 41 is pressed against the clamping part 42 of the retaining panel 34 and against the side face 23*b* of the cross-member 23 to thus obtain a particularly reliable seat of the mounting bolt 9 on the cross-member 23. On the other side of the cross-member 23 there may be additionally provided a corresponding clamp 40 to also apply pressure on the cross-member 23 from the other side.

The flange 32 mounted on both ends of the cross-member 23 comprises holes 33 through which bolts are passed to thus connect the flange 32 with any of the sidewalls 3, 4.

The longitudinal members 31 are connected with the retaining panel 34 by means of bolts 44 and 45. Presently, the longitudinal members 31 are configured as C-profiles, each extending longitudinally from one cross-member 23 to the next cross-member 23. It is a considerable advantage of the screening machine 1 that each longitudinal member is connected with a mounting tie 9 or with a cross-member 23 at each of its ends 31*a* by way of two screwed connections 44, 46 and 45, 46.

This permits a transfer of bending moments from one longitudinal member 31 to the next longitudinal member 31 and to the cross-members 23 so as to increase the vibratory rigidity.

The side faces 23*b* of each cross-member 23 are provided with wear protection devices 51 configured as wear protection panels clamped to mounting profiles 53. The mounting profiles 53 are clipped onto the threaded portions of the bolts 38 with their clipping portions 53*a*, serving for one as wear protection for the threaded portions of the bolts 38 and for another as profiles for other components and in particular lateral wear protection panels 51 to be clamped thereon. To this end the mounting profiles 53 comprise mushroom-shaped lugs 53*b* on each side to clamp the wear protection panels 51 on by means of mushroom-shaped grooves.

The top face 23*c* of the cross-members 23 is protected by means of upper wear protection panels 52 from knocks and shocks or a direct, abrasive attack by the bulk material. The longitudinal sides are provided at the upper wear protection panels 52 with protective side strips 52*a* protruding downwardly and overlapping the wear protection side panels 51 to safely keep bulk material falling down from above away from the hollow space 51*b* between wear protection side panels 51 and the cross-member 23.

The wear protection side panels 51, which are retained by clamps only, are effectively prohibited from slipping down by way of wider shoulders 37*a* at the counterpanel 37 which support the wear protection side panels 51 from beneath as necessary.

Both the wear protection side panels 51 and the upper wear protection side panels 52 are so received at the mounting ties that said mounting ties 9 fulfill a double function in a very advantageous way in that they support the screen lining through the longitudinal members 31 and reliably protect the cross-members 23 from abrasion. Moreover, fastening each longitudinal member to the mounting tie 9 with two bolts each at each of its ends 31*a* allows a bend-resistant connection of the longitudinal members 31 with one another and with the cross-members 23 which again contributes to the rigidity of the screening machine 1.

The screening machine illustrated in the exemplary embodiment allows a modular structure and a modular expansion of the screening machine, wherein the flexible mounting of the longitudinal members 31 to the cross-members 23 allows to select a variable screen width so as to allow employing screen lining systems of different manufacturers.

What is claimed is:

1. A vibrating screening machine (1) for grading bulk material, comprising a housing (2) and at least two sidewalls (3, 4) on which at least one screen deck (5-7) is mounted, on which a screen lining (8) is retained, and a drive means (19) to cause the screen deck (5-7) to vibrate, wherein via at least one material feed (10), bulk material to be screened is fed and via at least one fine-grain discharge (12), fine-grain bulk material is discharged, and via at least one coarse-grain discharge (11), coarse-grain bulk material is discharged, characterized in that at least all mounting points (14) provided on the sidewalls (3, 4) for mounting flanges (32) of cross-members (23) and all mounting points (27) of mounting means (26) for mounting reinforcing units (24) on the sidewall (3, 4) are aligned with a defined grid (15), the grid (15) comprising grid points (16) aligned with an x-y system of coordinates whose x-coordinate (x) and whose y-coordinate (y) define a system angle, wherein the system angle is different from 90°.

2. The vibrating screening machine (1) according to claim 1, wherein two or more screen decks (11-13) are provided whose mounting points (14) on the sidewalls (3, 4) are aligned with the grid (15).

3. The vibrating screening machine according to claim 1, wherein at least one screen deck (5-7) is disposed at a screen angle of inclination (18) relative to the horizontal (20).

4. The vibrating screening machine according to claim 1, wherein the grid distance (21) in the direction of the x-coordinate is different from the grid distance (22) in the direction of the y-coordinate.

5. The vibrating screening machine according to claim 1, wherein the cross-members (23) of the screen deck (5-7) are flange-mounted on the sidewalls (3, 4).

6. The vibrating screening machine according to claim 1, wherein at least one reinforcing unit (24) is disposed on and connected with the sidewall (3, 4) and forms a hollow profile.

7. The vibrating screening machine according to claim 1, wherein at least some of the mounting points (27) for mounting the reinforcing unit (24) also serve for mounting the cross-members (23).

8. The vibrating screening machine according to claim 1, wherein vertical reinforcing units (28) are provided on the sidewall (3, 4) and aligned in particular substantially parallel to the y-coordinate (y).

9. The vibrating screening machine according to claim 8, wherein two reinforcing units (28) each and some of the cross-members (23) form one vertical frame (61) each which contributes to reinforcing the housing.

10. The vibrating screening machine according to claim 1, wherein longitudinal reinforcing units (29) are provided on the sidewall (3, 4) which are aligned in particular substantially parallel to the x-coordinate (x).

11. The vibrating screening machine according to claim 10, wherein some longitudinal reinforcing units (28) and some of the cross-members (23) form one longitudinal frame (62, 63) each which contributes to reinforcing the housing.

12. The vibrating screening machine according to claim 1, wherein some vertical reinforcing units (28) and some longitudinal reinforcing units (29) form one side frame (64) which contributes to reinforcing the housing.

13. The vibrating screening machine according to claim 12, wherein the sidewall (3, 4) is incorporated in the side frame (64).

* * * * *